US007513365B2

(12) United States Patent
Cornelius et al.

(10) Patent No.: US 7,513,365 B2
(45) Date of Patent: Apr. 7, 2009

(54) STACKABLE CONTAINER

(75) Inventors: Adam C. Cornelius, Hayden, AL (US); Eric J. Oberliesen, Monroe, MI (US)

(73) Assignee: International Paper Company, Memphis, TN (US)

( * ) Notice: Subject to any disclaimer, the term of this patent is extended or adjusted under 35 U.S.C. 154(b) by 375 days.

(21) Appl. No.: 11/049,625

(22) Filed: Feb. 2, 2005

(65) Prior Publication Data

US 2005/0173280 A1 Aug. 11, 2005

Related U.S. Application Data

(60) Provisional application No. 60/541,104, filed on Feb. 2, 2004.

(51) Int. Cl.
*B65D 19/00* (2006.01)

(52) U.S. Cl. ..... 206/386; 206/600; 108/56.1

(58) Field of Classification Search ..... 206/386, 206/595, 597, 598, 599, 600; 108/51.11, 108/53.1, 56.1
See application file for complete search history.

(56) References Cited

U.S. PATENT DOCUMENTS

| | | | | |
|---|---|---|---|---|
| 2,918,190 | A | 12/1959 | Martin | |
| 4,000,704 | A * | 1/1977 | Griffin, Jr. | 108/53.1 |
| 4,305,508 | A * | 12/1981 | Rodgers | 211/85.8 |
| 4,606,461 | A * | 8/1986 | Bolton, Sr. | 206/600 |
| 4,694,962 | A * | 9/1987 | Taub | 206/600 |
| 4,927,026 | A | 5/1990 | Gossler et al. | |
| 5,218,913 | A * | 6/1993 | Winebarger et al. | 108/51.3 |
| 5,318,219 | A | 6/1994 | Smith | |
| 5,441,154 | A * | 8/1995 | Youell, III | 206/599 |
| 5,461,988 | A * | 10/1995 | Cummings et al. | 108/51.3 |
| 5,542,541 | A | 8/1996 | Smith | |
| 6,050,410 | A * | 4/2000 | Quirion | 206/386 |
| 6,155,181 | A * | 12/2000 | Chilcutt | 108/51.3 |
| 6,332,535 | B1 * | 12/2001 | Usui et al. | 206/386 |
| 6,484,899 | B1 | 11/2002 | Garton | |
| 2002/0139702 | A1 * | 10/2002 | Greene | 206/386 |
| 2003/0052038 | A1 | 3/2003 | Boersma | |
| 2003/0102248 | A1 * | 6/2003 | Lang et al. | 206/600 |
| 2003/0102309 | A1 | 6/2003 | Hartwall | |
| 2004/0118742 | A1 * | 6/2004 | Shuert | 206/600 |

FOREIGN PATENT DOCUMENTS

| | | |
|---|---|---|
| DE | 19508101 | 1/1995 |
| WO | WO 93/17923 | 3/1992 |

* cited by examiner

*Primary Examiner*—David T Fidei
(74) *Attorney, Agent, or Firm*—Matthew M. Eslami

(57) ABSTRACT

The present invention provides a stackable container having a plurality of pallet blocks arranged to define a pallet block matrix and a container unit adapted to rest upon the pallet block matrix, wherein one or more of the pallet blocks is adapted to positively position the container relative to a support.

48 Claims, 7 Drawing Sheets

STACKABLE CONTAINER

CROSS-REFERENCE TO RELATED APPLICATION(S)

This application claims priority to U.S. patent application Ser. No. 60/541,104, filed on 2 Feb. 2004, which is hereby incorporated by reference hereinto.

BACKGROUND OF THE INVENTION

1. Technical Field of the Invention

The present invention relates to containers for shipping and storing articles, such as automotive component parts. More particularly, the present invention relates to containers for shipping and storing articles, wherein the containers are adapted to be arranged in a stacked, interlocking manner with one another, or with similar storage bins.

2. Brief Description of the Related Art

It is well known to transport articles in protective containers to prevent damage to the articles while in transit. For example, in the automotive industry, automotive component parts may be transported from one facility to another (such as, from a manufacturing or machining facility to an assembly facility) during the overall process of building an automobile. In one case, automotive wiring harnesses may be assembled from sub-component parts in one facility and then shipped to a final assembly facility where the wiring harnesses will be installed in automobiles. Protective containers, such as returnable plastic containers ("RPC's") are used typically to transport such component parts from one facility to another. It is therefore desirable to provide a container for shipping articles.

Once at a destination facility, a typical RPC also provides storage for the component parts shipped to the destination facility therein until such time as the component parts are needed. It is not uncommon for the component parts to be stored in the RPC for a long period of time, possibly for several weeks, until the component parts are required. For this reason, typical RPC's are modular in construction and are adapted to be stacked upon one another in an interlocking manner. It is therefore desirable to provide a container for shipping articles that may be used as a storage bin for either short-term or long-term storage of the articles shipped therein. It is also desirable to provide a shipping/storage container that is modular in construction and that is adapted to be arranged in a stacked and interlocking manner. It is also desirable to provide a shipping/storage container that is adapted to be handled by ordinary equipment, such as forklifts and inventory control systems.

Known shipping/storage containers, such as RPC's, typically are constructed from expensive rigid plastic materials, so that they can be reused. The cost of such containers typically is high, because the materials used to construct such containers are expensive. It is therefore desirable to provide a shipping/storage container that is constructed from inexpensive materials.

Moreover, return-shipping of empty containers (i.e., returning an empty RPC to the shipping facility once the destination facility has removed the component parts therefrom) is costly and inefficient. For this reason, many shipping/storage containers, such as RPC's, are built-up structures comprised of a number of rectangular flat wall members which can be arranged and interlocked with one another to form a box-like built-up construction, but which can be broken-down for return-shipping. Once the component parts are removed from the RPC's for use, the RPC's are disassembled and the flat RPC wall members are returned to the shipping facility for reuse. It is therefore desirable to provide a shipping/storage container that is adapted to be arranged in a broken-down orientation so as to permit efficient shipping thereof, but that is also adapted to be arranged in a built-up orientation so as to permit use thereof as a shipping container and storage bin.

Destination facilities, however, do not always return the broken-down RPC's, and it is a common problem that shipping facilities do not consistently receive their RPC's from the destination facilities. It is therefore desirable to provide a shipping/storage container that is suitable for one-time use, thereby eliminating the need to return the shipping/storage container to the shipping facility. It is also desirable, however, to provide a shipping/storage container that is suitable for one-time use, but that is constructed from sufficiently durable materials so as to permit repeated use thereof, if desired.

It is not uncommon for end-users of conventional shipping/storage containers, such as RPC's, to use RPC's along with a variety of other storage bins, such as simple corrugated bins. However, conventional shipping/storage containers, such as RPC's are not interchangeable with these other storage bins, thereby requiring the RPC's to be stacked/stored separately from the other storage bins. It is therefore desirable to provide a shipping/storage container that is interchangeable with conventional shipping/storage containers, such as RPC's.

SUMMARY OF THE INVENTION

The present invention is for a container suitable for shipping and storing articles therein. A container according to a preferred embodiment of the present invention is constructed from an inexpensive, disposable material, such as paper, corrugated paperboard, or the like, having sufficient stiffness and strength for the purposes discussed herein. A container according to the present invention is a built-up structure formed from one or more substantially planar container part blanks having a plurality of flaps, slits, scorelines and foldlines. For example, a container according to a preferred embodiment of the present invention includes: a pallet constructed from lower and upper pallet blocks, and a pallet deck for cooperating with the lower and upper pallet blocks to define a pallet; a lower and upper tray, each constructed from a foldable planar tray blank; and, a sidewall body constructed from one or more foldable planar sidewall blanks. The pallet deck is constructed from a planar blank having sufficient stiffness and strength to support the weight of the container contents thereon. Each of the pallet blocks are constructed from a laminated corrugated built-up structure for providing sufficient bending stiffness to support the weight of the container contents thereon.

According to one embodiment of the present invention, one or more of the pallet blocks define a shoulder for stacking one container according to the present invention atop another container according to the present invention, or for stacking one container according to the present invention atop a conventional shipping/storage container, such as an RPC. According to one alternative embodiment of the present invention, at least one of the pallet blocks includes an indexing feature, such as, for example, a cone-receiving recess for receiving therein an indexing element, such as, for example, a cone protrusion extending from another shipping/storage container, for positioning the containers relative to one another and for preventing relative movement therebetween.

According to another alternative embodiment of the present invention, the sidewall body is collapsible to permit the container according to the present invention to assumed a broken-down orientation, thereby making the container easy to transport. Once at its final destination, the sidewall body may be erected and positioned on the lower tray to define a built-up orientation of the container suitable for shipping and storing articles therein.

According to yet another alternative embodiment of the present invention, one or more pallet block cross-members are provided to increase stiffness of the pallet and to prevent deformation thereof when the container is erected and filled.

It is an object of the present invention to provide a container for shipping articles.

It is another object of the present invention to provide a container for shipping articles that may be used as a storage bin for either short-term or long-term storage of the articles shipped therein.

It is furthermore an object of the present invention to provide a shipping/storage container that is modular in construction and that is adapted to be arranged in a stacked and interlocking manner.

It is even further an object of the present invention to provide a shipping/storage container that is adapted to be handled by ordinary equipment, such as forklifts and inventory control systems.

It is yet another object of the present invention to provide a shipping/storage container that is constructed from inexpensive materials.

It is still another object of the present invention to provide a shipping/storage container that is adapted to be arranged in a broken-down orientation so as to permit efficient shipping thereof, but that is also adapted to be arranged in a built-up orientation so as to permit use thereof as a shipping container and storage bin.

It is another object of the present invention to provide a shipping/storage container that is suitable for one-time use, thereby eliminating the need to return the shipping/storage container to the shipping facility.

It is still another object of the present invention to provide a shipping/storage container that is suitable for one-time use, but that is constructed from sufficiently durable materials so as to permit repeated use thereof, if desired.

It is yet another object of the present invention to provide a shipping/storage container that is interchangeable with conventional shipping/storage containers, such as RPC's.

These and other objects, features and advantages of the present invention become apparent to those of ordinary skill in the art from the description which follows, and may be realized by means of the instrumentalities and combinations particularly pointed out therein, as well as by those instrumentalities, combinations and improvements thereof which are not described expressly therein, but which would be obvious to those of ordinary and reasonable skill in the art.

According to one aspect of the present invention, a stackable container is provided having a plurality of pallet blocks arranged to define a pallet block matrix and a container unit adapted to rest upon the pallet block matrix, wherein one or more of the pallet blocks is adapted to positively position the container relative to a support.

BRIEF DESCRIPTION OF THE DRAWINGS

A better understanding of the invention will be had upon reference to the following description in conjunction with the accompanying drawings in which like reference numerals represent like parts, and wherein.

DETAILED DESCRIPTION OF THE PREFERRED EMBODIMENTS

Figure 1:
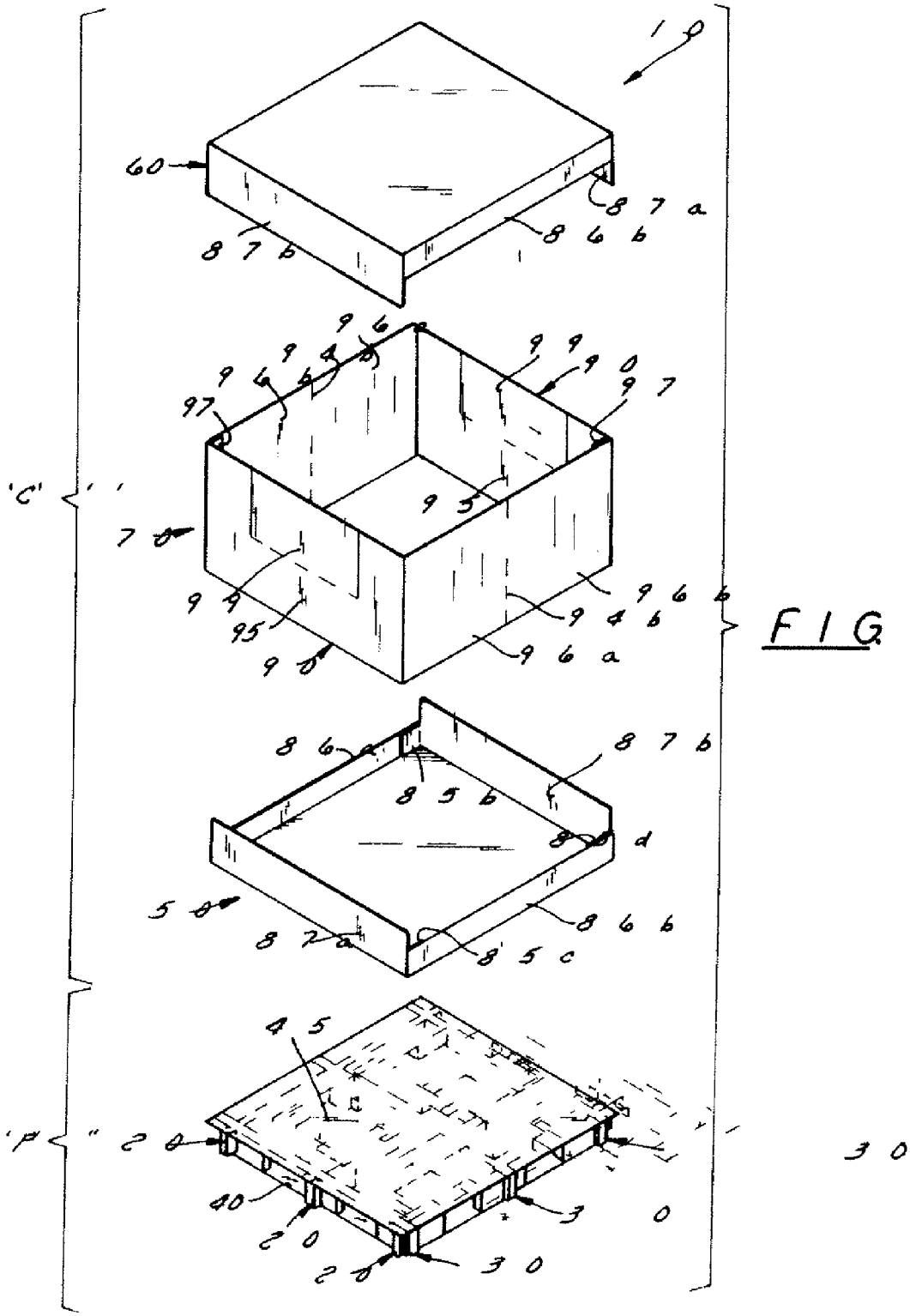
FIG. 1 is an exploded perspective view of a container assembly according to a preferred embodiment of the present invention.

With reference to FIG. 1, a container assembly 10 according to a preferred embodiment of the present invention includes one or more lower pallet blocks 20, one or more upper pallet blocks 30, a pallet deck 40, a slipsheet 45, a lower tray 50, an upper tray 60 and a sidewall body 70. The pallet blocks 20, 30, the pallet deck 40 and the slipsheet 45 collectively define a pallet "P". The trays 50, 60 and the sidewall body 70 collectively define a container unit "C", which is sized sufficiently to contain articles therein for shipment and/or storage. The container unit "C" and the pallet "P" are respectively sized so that the pallet "P" can support the weight of the container unit "C" and of the articles shipped and/or stored therein. The container unit "C" may be adhered or otherwise affixed, either permanently or removably, from the pallet "P" or the container unit "C" may simply rest on the pallet "P" without being adhered or affixed thereto. For example, adhesives, glues, staples, nails, straps, or the like, may be used to couple the container unit "C" to the pallet "P". as will be described in greater detail below, one or more of the pallet blocks 20, 30 are adapted to positively engage a support, such as am open upper end of another container upon which the container assembly 10 has been placed. Alternatively, the support may be in the form of a stand (not shown) for storing multiple, stacked containers or a locking tray (not shown) provided in a floor of a transportation carrier (such as a train, ship or delivery truck) for securing the container assembly 10 in a desired position/location/orientation during transport and delivery.

Preferably, three lower pallet blocks 20 and three upper pallet blocks 30 are arranged in spaced relation to one another to define a pallet block matrix 20, 30, wherein the three lower pallet blocks 20 are arranged in parallel, spaced relation to one another and wherein the three upper pallet blocks 30 are arranged in parallel, spaced relation to one another such that the three upper pallet blocks 30 are at some angle (preferably 90°, although any angular orientation may be used) relative to the three lower pallet blocks 20. As will be discussed in greater detail below, the lower pallet blocks 20 and the upper pallet blocks 30 each are configured to matingly engage at least one other pallet block 20, 30 so as to be interlocked with one another. The pallet block matrix 20, 30, then, forms a fixed structure having sufficient stiffness and strength to support the container unit "C" thereon for shipping and/or storage. The pallet deck 40, which has a substantially planar, rectangular shape, is positioned under the pallet block matrix 20, 30 and may be adhesively (or otherwise) affixed to the pallet block matrix 20, 30 for the purpose of defining a substantially planar surface upon which the entire container assembly 10 may rest. The pallet 40 deck also serves to fix the pallet blocks 20, 30 in a predetermined arrangement.

Figure 2:
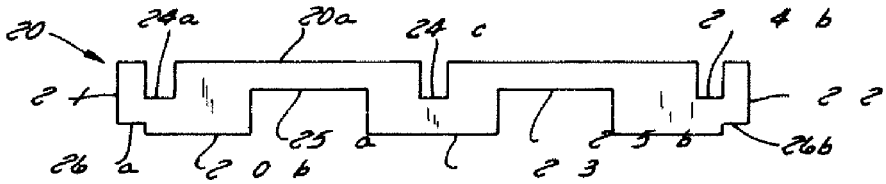
FIG. 2 is a side view of a lower pallet block of the container assembly according to a preferred embodiment of the present invention shown in FIG. 1.

With reference now to FIG. 2, the lower pallet block 20 preferably is a generally elongated beam element having a first end 21, a second end 22 and a center section 23. The lower pallet block 20 may have any suitable cross-section for resisting bending thereof, and preferably includes a generally-rectangular cross-section. The lower pallet block 20 preferably is constructed from one or more individual corrugated sheets (not shown) arranged in a side-by-side vertical orientation laminated together to form a unitary member, as described herein.

One or more downward cutouts 24*a*, 24*b*, 24*c* are provided in a top surface 20*a* of the lower pallet block 20 spaced along the length of the lower pallet block 20, and preferably three downward cutouts 24*a*, 24*b*, 24*c* (that is, one cutout for each upper pallet block 30 of the pallet "P" according to a preferred embodiment hereof) are provided, wherein a first downward cutout 24*a* is provided near the first end 21 of the lower pallet block 20, a second downward cutout 24*b* is provided near the second end 22 of the lower pallet block 20, and a third downward cutout 24*c* is provided in the center section 23 of the lower pallet block 20.

One or more recesses 25*a*, 25*b* are provided in a bottom surface 20*b* of the lower pallet block 20 spaced along the length of the lower pallet block 20, and preferably two recesses 25*a*, 25*b* are provided, wherein a first recess 25*a* is provided spaced between the first downward cutout 24*a* and the third downward cutout 24*c*, and wherein a second recess 25*b* is provided spaced between the second downward cutout 24*b* and the third downward cutout 24*c*.

As will be described in greater detail below, a first shoulder 26*a* is provided near the first end 21 of the lower pallet block 20, extending upwardly from the bottom surface 20*b* thereof, and a second shoulder 26*b* is provided near the second end 22 of the lower pallet block 20, extending upwardly from the bottom surface 20*b* thereof. Shoulders 26*a*, 26*b* are preferably spaced from the lower surface 20*b* towards the upper surface 20*a* thereof.

Figure 3:
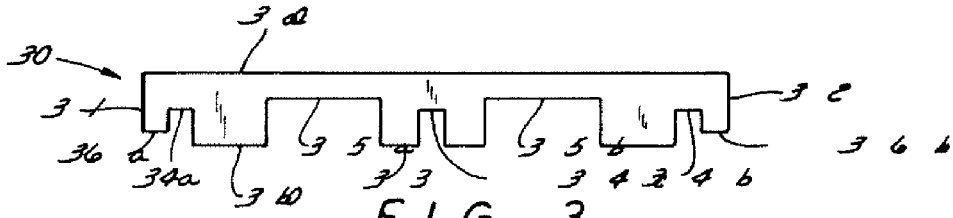
FIG. 3 is a side view of a upper pallet block of the container assembly according to a preferred embodiment of the present invention shown in FIG. 1.

With reference now to FIG. 3, the upper pallet block 30 preferably is a generally elongated beam element having a first end 31, a second end 32 and a center section 33. The upper pallet block 30 may have any suitable cross-section for resisting bending thereof, and preferably includes a generally-rectangular cross-section. The upper pallet block 30 preferably is constructed from one or more individual corrugated sheets (not shown) arranged in a side-by-side vertical orientation laminated together to form a unitary member, as described herein.

One or more upward cutouts 34*a*, 34*b*, 34*c* are provided in a bottom surface 30*b* of the upper pallet block 30 spaced along the length of the upper pallet block 30, and preferably three upward cutouts 34*a*, 34*b*, 34*c* (that is, one cutout for each lower pallet block 20 of the pallet "P" according to a preferred embodiment hereof) are provided, wherein a first upward cutout 34*a* is provided near the first end 31 of the upper pallet block 30, a second upward cutout 34*b* is provided near the second end 32 of the upper pallet block 30, and a third upward cutout 34*c* is provided in the center section 33 of the upper pallet block 30.

One or more recesses 35*a*, 35*b* are provided in the bottom surface 30*b* of the upper pallet block 30 spaced along the length of the upper pallet block 30, and preferably two recesses 35*a*, 35*b* are provided, wherein a first recess 35*a* is provided spaced between the first upward cutout 34*a* and the third upward cutout 34*c*, and wherein a second recess 35*b* is provided spaced between the second upward cutout 34*b* and the third upward cutout 34*c*.

As will be described in greater detail below, a first shoulder 36*a* is provided near the first end 31 of the upper pallet block 30 and a second shoulder 36*b* is provided near the second end 32 of the upper pallet block 30. Shoulders 36*a*, 36*b* are preferably spaced from the lower surface 30*b* towards the upper surface 30*a* thereof.

Referring now generally to FIGS. 1-3, the pallet block matrix 20, 30 is assembled by orienting the upper and lower pallet blocks 20, 30, respectively, as described above, such that the downward cutouts 24*a*, 24*b*, 24*c* of the lower pallet blocks 20 are received by and mate with the upward cutouts 34*a*, 34*b*, 34*c* of the upper pallet blocks 30. Recesses 25*a*, 25*b*, 35*a*, 35*c* are sized and positioned on the pallet blocks 20, 30, respectively, so that openings are defined in the sides of the pallet, thereby permitting the pallet to be lifted and transported using conventional equipment, such as a forklift.

Figure 4:
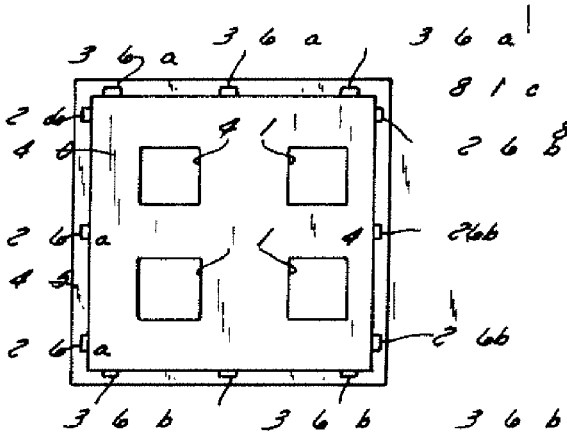
FIG. 4 is a bottom view of a pallet deck of the container assembly according to a preferred embodiment of the present invention shown in FIG. 1.

With combined reference to FIGS. 1 and 4, the pallet deck 40 is a substantially planer, rectangular surface member sized to fit under the assembled pallet block matrix 20, 30 of lower pallet blocks 20 and upper pallet blocks 30 for the purpose of providing a surface upon which multiple containers of the present invention may be stacked.

Preferably, the pallet deck 40 comprises one or more layers of corrugated material, which may be laminated together to form a unitary surface element with increased stiffness and strength. The pallet deck 40 may include one or more openings 41 therethrough and arranged thereon for the purpose of reducing the amount of material required to manufacture the pallet deck 40. The pallet deck 40 may be adhesively (or otherwise) affixed to the bottom surfaces 20*b*, 30*b* of the lower and upper pallet blocks 20, 30, respectively.

A slipsheet 45 may be provided to cover the pallet block matrix 20, 30 and to provide a substantially planar surface upon which the container unit "C" may rest upon the pallet "P" and to which the container unit "C" may be adhered or otherwise attached. The slipsheet 45 may be constructed from the same material as the pallet deck 40 and may have the same dimensions of the pallet deck 40, although it is preferable for the pallet deck 40 to have a slightly smaller surface area than the slipsheet 45, so as to be spaced inwardly therefrom, when the assembled pallet "P" is viewed from below. The slipsheet 45 may be adhesively (or otherwise) affixed to the upper surfaces 20*a*, 30*a* of the lower and upper pallet blocks 20, 30, respectively.

Figure 5:
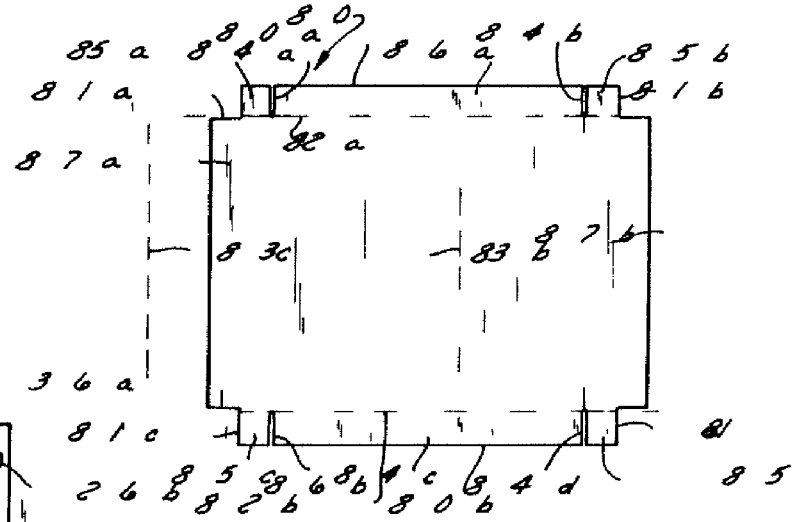
FIG. 5 is a top view of a foldable tray blank of the container assembly according to a preferred embodiment of the present invention shown in FIG. 1.

With reference to FIGS. 1 and 5, lower and upper trays 50, 60, respectively, preferably are each formed from a foldable tray blank 80, which is constructed from paper, corrugated paperboard, or the like, having generally planar and rectangular dimensions (when in an unfolded, flat orientation). Tray blank 80 includes corner cutouts 81*a*, 81*b*, 81*c*, 81*d*, parallel edge foldlines 82*a*, 82*b* extending from corner cutouts 81*a*, 81*c* to corner cutouts 81*b*, 81*d*, respectively, and parallel end foldlines 83*a*, 83*b* extending from corner cutouts 81*a*, 81*b* to corner cutouts 81*c*, 81*d*, respectively.

Slits 84*a*, 84*b* each extend from a first edge foldline 82*a* to an outer peripheral edge 80*a* of the tray blank 80 near a first corner cutout 81*a* and a second corner cutout 81*b*, respectively, thereby defining first and second corner flaps 85*a*, 85*b*. Slits 84*c*, 84*d* each extend from a second edge foldline 82*b* to an outer peripheral edge 80*b* of the tray blank 80 near a third corner cutout 81*c* and a fourth corner cutout 81*d*, respectively, thereby defining third and fourth corner flaps 85*c*, 85*d*.

First and second corner cutouts 81*a*, 81*b*, respectively, first edge foldline 82*a* and first and second slits 84*a*, 84*b*, respectively, cooperate to define a first edge flap 86*a*; second and third corner cutouts 81*c*, 81*d*, respectively, second edge foldline 82*b* and first and second slits 84*c*, 84*d*, respectively, cooperate to define a second edge flap 86*b*; first and third corner cutouts 81*a*, 81*c*, respectively, first end foldline 83*a* and first and third slits 84*a*, 84*c*, respectively, cooperate to define a first end flap 87*a*; and, second and fourth corner cutouts 81*b*, 81*d*, respectively, second end foldline 83*b* and second and fourth slits 84*b*, 84*d*, respectively, cooperate to define a second end flap 87*b*.

With reference particularly to FIG. 1, the tray blank 80 is configured to form lower and upper trays 50, 60, respectively, by first folding first and second corner flaps 85*a*, 85*b*, respectively, about first edge foldline 82*a* to be substantially perpendicular to the plane of the tray blank 80. Third and fourth corner flaps 85*c*, 85*d*, respectively, are then folded about second edge foldline 82*c* so that they are substantially perpendicular to the plane of the tray blank 80. First and second end flaps 87*a*, 87*b*, respectively, are then folded about first and second end foldlines 83*a*, 83*b*, respectively, so that end flaps 87*a*, 87*b* are substantially perpendicular to the plane of the tray blank 80. First and second edge flaps 86*a*, 86*b*, respectively, are then each folded about first and second edge foldlines 82*a*, 82*b*, respectively, so that edge flaps 86*a*, 86*b* are substantially perpendicular to the plane of the tray blank 80.

Corner flaps 85*a* are then each adhesively (or otherwise) affixed to an interior surface of first edge flap 86*a* and corner flaps 85*c*, 85*d* are each adhesively (or otherwise) affixed to an interior surface of the second edge flap 86*b*, thereby defining an open-topped shallow box-like configuration, shown in FIG. 1. End flaps 87*a*, 87*b* each extend from the plane of the tray blank 80 a distance that is greater than a distance between the plane of the tray blank 80 and the peripheral edges 80*a*, 80*b* thereof when in the box-like configuration shown in FIG. 1. This allows the end flaps 87*a*, 87*b* of the upper tray 60 to telescope over the end flaps 87*a*, 87*b* of the lower tray 50, thereby defining a closed-in orientation.

Figure 6:
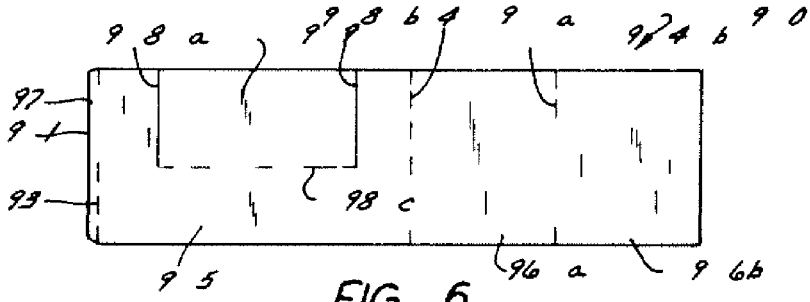
FIG. 6 is a top view of a foldable sidewall body blank of the container assembly according to a preferred embodiment of the present invention shown in FIG. 1.

Referring now to FIG. 6, the sidewall body 70 (FIG. 1) is constructed from two sidewall blanks 90 adhesively affixed to one another in an end-to-end relation and then folded to define a generally box-like construction, open at two ends thereof. More particularly, each sidewall blank 90 preferably is constructed from paper, corrugated paperboard, or the like, and is generally rectangular in dimensions. The sidewall panel 90 has a first end 91 and a second end 92. A flap-forming foldline 93 is provided near the first end 91 and first and second endwall foldlines 94*a*, 94*b* are provided spaced from the flap-forming foldline 93 towards the second end 92 sufficient distances therefrom to define a endwall panel 95 between the flap-forming foldline 93 and the first endwall foldline 94*a*, a first sidewall panel 96*a* between the first endwall foldline 94*a* and the second endwall foldline 94*b*, and a second sidewall panel 96*b* between the second endwall foldline 94*b* and the second end 92. First and second endwall panels 94*a*, 94*b* are roughly equal in dimension, and endwall panels 94*a*, 94*b* are roughly half the size of the endwall panel 95.

Referring now also to FIG. 1, the sidewall body 70 is formed by placing two sidewall blanks 90 in end-to-end relation such that the first end 91 of a first sidewall blank 90 is adhesively (or otherwise) affixed to the second end 92 of the second sidewall blank 90. Alternatively, sidewall body 70 may be formed from a single sidewall blank (FIG. 12) having sufficient length and foldlines such that a first end is adhesively affixable to a second end thereof.

Sidewall body 70, when erected, is sized to fit within the lower tray 50 and may be adhesively (or otherwise) affixed thereto, such as by providing an adhesive on an interior surface of the up-turned flaps 86*a*, 86*b*, 87*a*, 87*b* of the lower tray 50, which contact an exterior surface of the erected sidewall body 70, near a lower open end thereof. Sidewall body 70 and lower tray 50 cooperate to define a shipping/storage bin into which articles (not shown) may be shipped and/or stored. Upper tray 60 (which is constructed substantially like lower tray 50, as described above), is sized to fit over an upper open end of the erected sidewall body 70, and may be adhesively (or otherwise, such as by stapling) affixed thereto, as described above with respect to the lower tray 50. The entire container unit "C" may be placed on the pallet "P" either with or without the upper tray 60. It will be obvious to those of ordinary skill in the art that if the container assembly 10 of the present invention is to provide a container suitable for broken-down shipment (as described in greater detail below) that the sidewall body need not be securely affixed to the lower tray 50 and upper tray 60, such as by adhesive, staples or the like. Rather, upturned flaps 86*a*, 86*b*, 87*a*, 87*b* of the lower and upper trays 50, 60, respectively, will surround lower and upper open ends of the sidewall body 70, respectively, thereby maintaining the sidewall body 70 in an open orientation.

One or more score lines (or foldlines) 98*a*, 98*b*, 98*c* may be provided in the endwall panel 95 of the sidewall blank 90 to define a removable window section 99 for the purpose of providing access to the contents of the built-up shipping/storage bin with requiring removal of the upper tray 60 from the erected sidewall body 70.

Figure 6A:
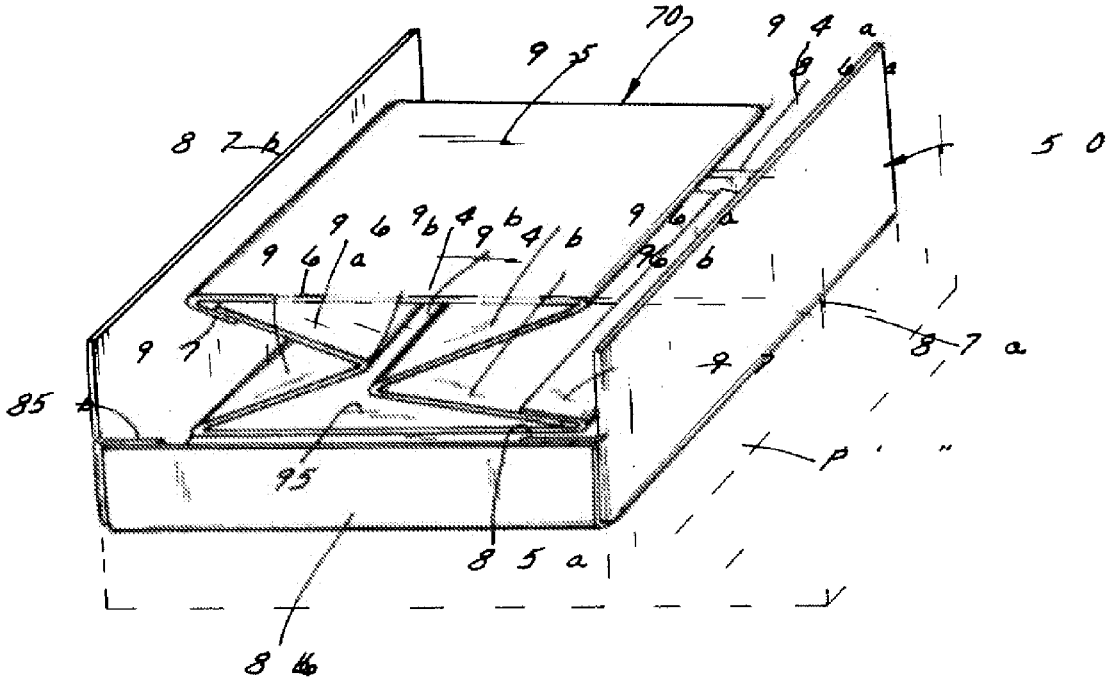
FIG. 6*a* is a perspective view showing the foldable sidewall body of the container assembly according to a preferred embodiment of the present invention shown in FIG. 6.

With reference to FIG. 6*a*, the sidewall panels 96*a*, 96*b* can be folded inwardly about the second foldline 94*b* so that the erected sidewall body 70 can assume a broken-down orientation suitable for shipping. More particularly, once broken-down, the sidewall body 70 can be stored within the lower and upper trays 50, 60 (not shown), respectively, which are sized to engage one another, as shown in FIG. 1.

Referring now back to FIG. 1, the container 10 according to a preferred embodiment of the present invention may be stacked on a conventional RPC, or may be stacked on another container 10 of the present invention. As described above, pallet blocks 20, 30 are each provided with shoulders 26*a*, 26*b*, 36*a*, 36*b*, which are sized to fit within an open upper end of a conventional RPC 5 and to support the container 10, for example, on an upstanding sidewall lip 6 of the RPC 5. Alternatively, shoulders 26*a*, 26*b*, 36*a*, 36*b* may be used to nest container 10 in an open upper end of another container 10. Alternatively still, one or more containers 10 may simply be stacked one atop another.

Figure 7:
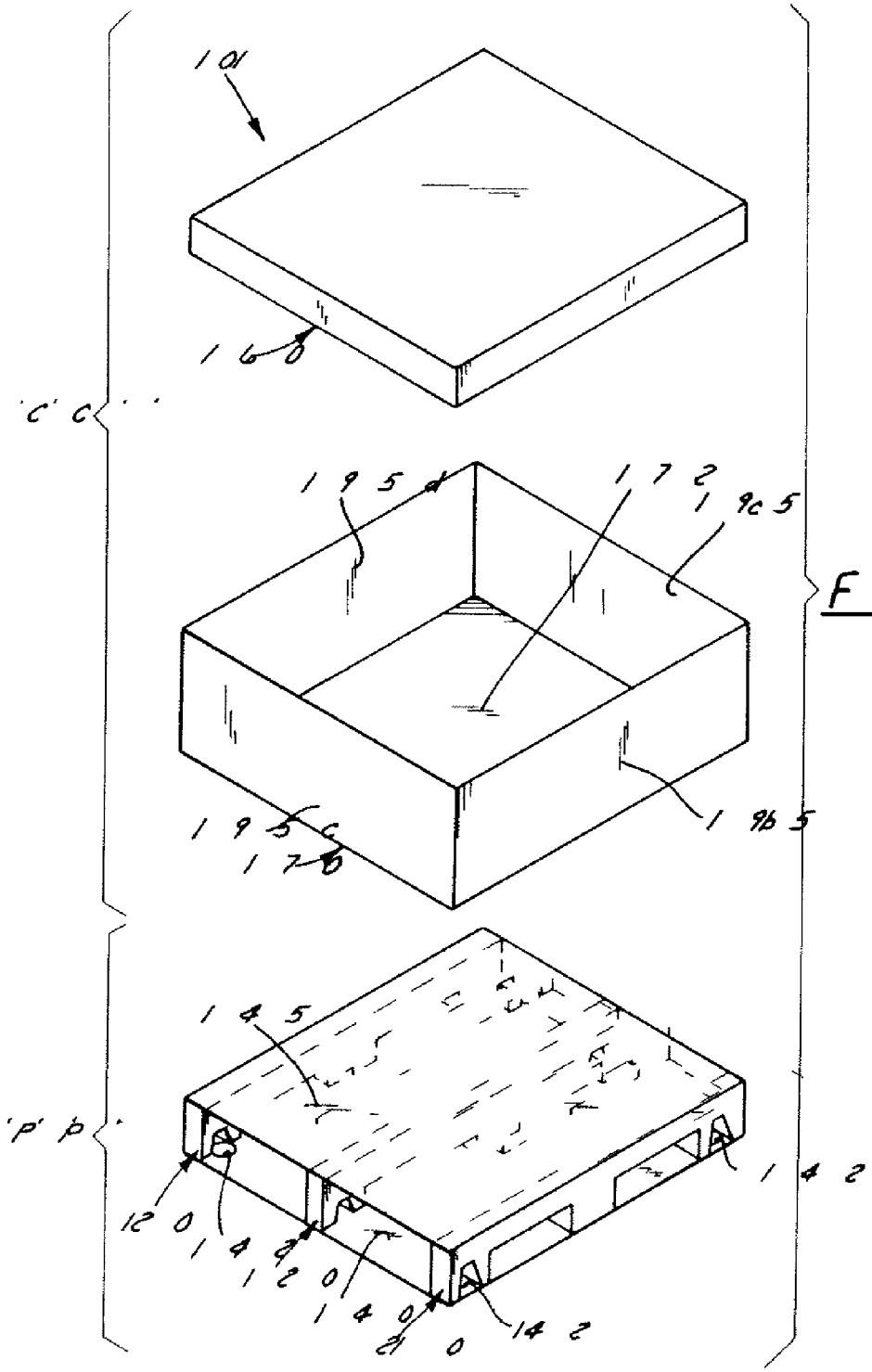
FIG. 7 is an exploded perspective view of a container assembly according to an alternative embodiment of the present invention.

With reference to FIG. 7, a shipping/storage container 110 according to an alternative embodiment of the present invention includes a pallet "PP" and a container unity "CC" which is sized to rest upon (and may be affixed thereto, such as, by adhesive) the pallet "PP". The pallet "PP" includes one or more pallet blocks 120, a pallet deck 140, and a slipsheet 145. The container unit "CC" includes a sidewall body 170 and an upper tray 160.

Figure 8:
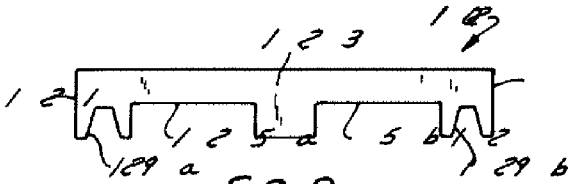
FIG. 8 is a side view of a pallet block of the container assembly according to an alternative embodiment of the present invention shown in FIG. 7.

Referring now also to FIG. 8, the pallet block 120 includes a first end 121, a second end 122, and a center section 123. The pallet block 120 may be constructed from paper or corrugated paperboard, similar to the pallet blocks 20, 30 according to the preferred embodiment described above. A first recess 125*a* is provided between the first end 121 and the center section 123 and a second recess 125*b* is provided between the second end 122 and the center section 123.

A first cone-receiving recess 129*a* is provided near the first end 121 and a second cone-receiving recess 129*b* is provided near the second end 122 for locating the pallet "PP" relative to an RPC or other container upon which the container 110 is stacked. For example, the upstanding lip of the RPC may include a conical projection. Recesses 129*a*, 129*b* are sized and shaped to receive the projection therein, thereby securely positioning the pallet "PP" (and the container unit "CC" resting thereon) relative to the RPC. Although recesses 129*a*, 129*b* have been described herein as mating with a cone-shaped projection, persons of ordinary skill in the art will recognize that any size, shape or configuration of projection may be used without departing from either the spirit or the scope of the present invention.

The container 110 according to the present alternative embodiment of the present invention is intended to rest on the full perimetrical upstanding lip of the RPC (or other container) and as such, the ends 121, 122 of the pallet blocks 120 need not include a shoulder, such as the shoulder 26*a*, 26*b*, 36*a*, 36*b* provided with respect to the pallet blocks 20, 30 used with respect to the container 10 according to the preferred embodiment of the present invention. With respect to the container 10 of the preferred embodiment hereof, the shoulders are required in order to interlock the container 10 and the RPC (or other container upon which the container 10 is stacked); however, with respect to the container 110 according to the present alternative embodiment hereof, the cone-receiving recesses 129*a*, 129*b* serve in part to locate and interlock the container 110 relative to the RPC (or other container upon which the container 110 is stacked). Nevertheless, the pallet blocks 120 of the present embodiment may be provided with both cone-receiving recesses 129*a*, 129*b* and shoulders (not shown) for the purpose of nesting the container 110 in an open upper end of the RPC (or other container upon which the container 110 is stacked). Preferably, cone-receiving recesses 129*a*, 129*b* would be provided in shoulders (not shown) because shoulders (not shown) rest on the upstanding lip of the RPC, or the like.

Referring now specifically to FIG. 7, a pallet block matrix formed from a plurality of pallet blocks 120 is assembled by positioning two or more pallet blocks 120 in generally-aligned, parallel relation to one another, spaced apart from one another by a preselected distance. The distance between outermost pallet blocks 120 may be chosen to be the same as the length of the pallet blocks 120, thereby defining a generally square planform for the pallet block matrix.

Figure 9:
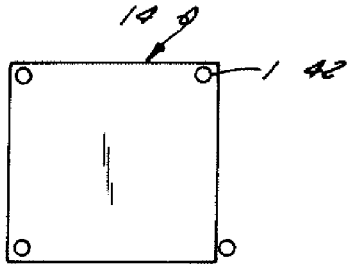
FIG. 9 is a top view of a first pallet deck of the container assembly according to an alternative embodiment of the present invention shown in FIG. 7.

Referring now also to FIG. 9, the pallet deck 140 is a substantially planar, rectangular surface member sized to fit under the assembled pallet block matrix formed from a plurality of pallet blocks 120 for the purpose of providing a surface upon which multiple containers may be stacked atop upon one another. Preferably, the pallet deck 140 comprises one or more layers of corrugated material, which may be laminated together to form a unitary surface element with increased stiffness and strength. The pallet deck 140 may include one or more openings 142 therethrough and arranged thereon for the purpose of providing access to the cone-receiving recesses 129*a*, 129*b* of the pallet blocks 120. The pallet deck 140 may be adhesively (or otherwise) affixed to the bottom surfaces of the pallet blocks 120.

A slipsheet 145 is provided to cover the pallet block matrix 120, 120, 120 and to provide a substantially planar surface upon which the container unit "CC" rests and to which the container unit "CC" may be adhered or otherwise attached. The slipsheet 145 may be constructed from the same material as the pallet deck 140 and may have the same dimensions of the pallet deck 140. The slipsheet 145 may be adhesively (or otherwise) affixed to the upper surfaces of the pallet blocks 120.

Figure 10:
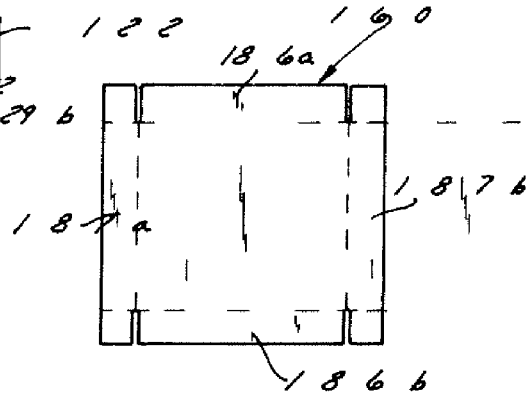
FIG. 10 is a top view of a foldable tray blank of the container assembly according to an alternative embodiment of the present invention shown in FIG. 7.

With reference to FIG. 10, upper tray 160 is constructed similarly to lower and upper trays 50, 60 of the container 10 of the preferred embodiment hereof, except that end flaps 187*a*, 187*b* and edge flaps 186*a*, 186*b* are all substantially the same size.

Figure 11:
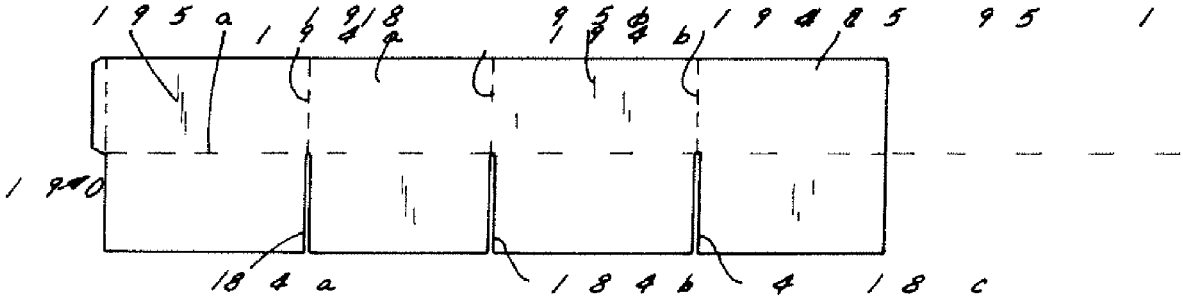
FIG. 11 is a top view of a foldable sidewall body blank of the container assembly according to an alternative embodiment of the present invention shown in FIG. 7.

Referring now to FIG. 11, the sidewall body 170 is constructed from a side wall blank 190 having preferably four wall panels 195*a*, 195*b*, 195*c*, 195*d* separated by foldlines 194*a*, 194*b*, 194*c*. In addition, flap-forming foldline 198 extends the length of the blank 190 and cooperates with flap-forming slits 184*a*, 184*b*, 184*c* to define flaps 181*a*, 181*b*, 181*c*, 181*d*, which cooperate with one another to define a closed bottom end 172 of the sidewall body 170, in a manner known generally to those or ordinary skill in the art.

Figure 12:
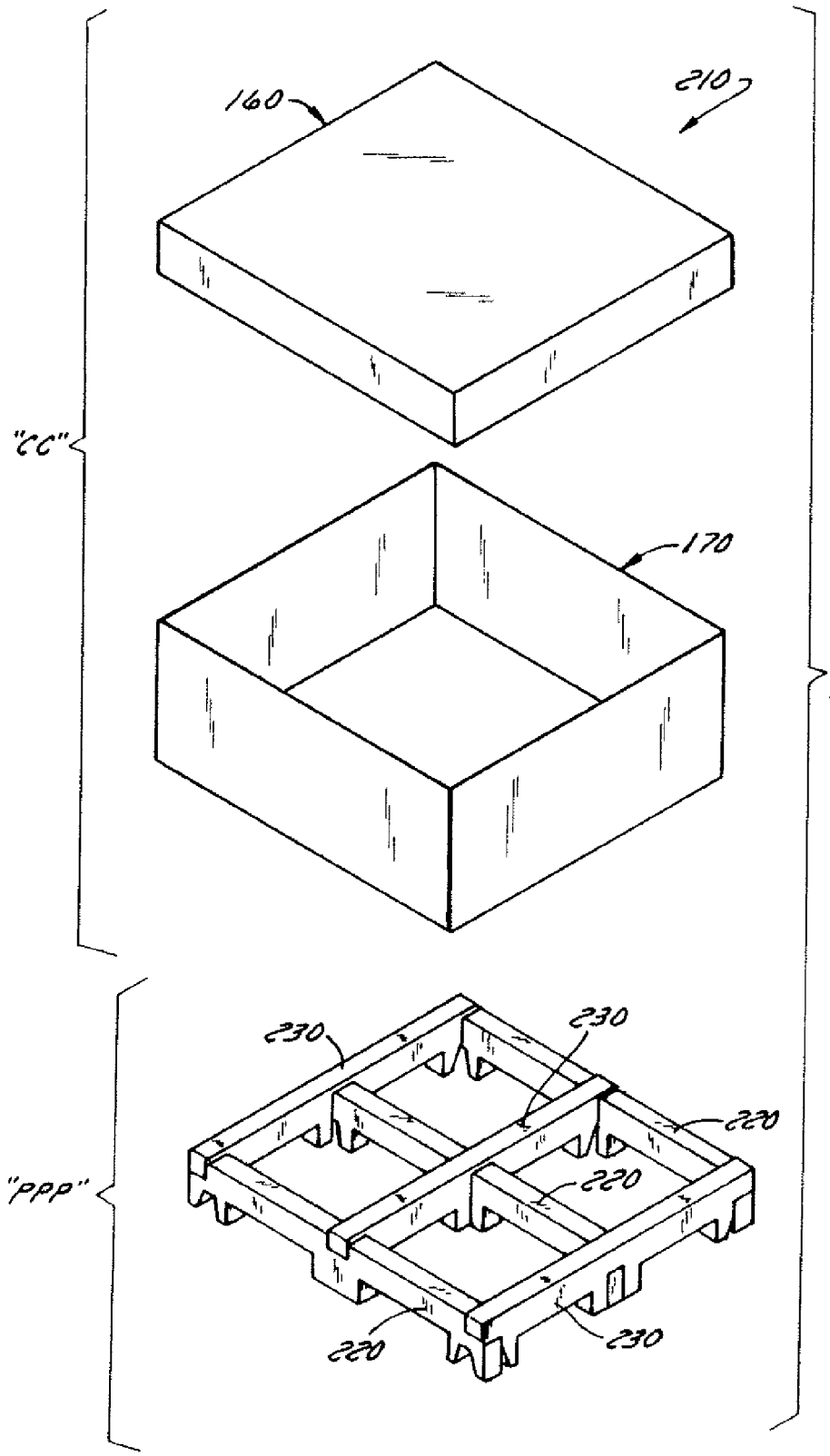
FIG. 12 is an exploded perspective view of a container assembly according to yet another alternative embodiment of the present invention.
Figure 13:
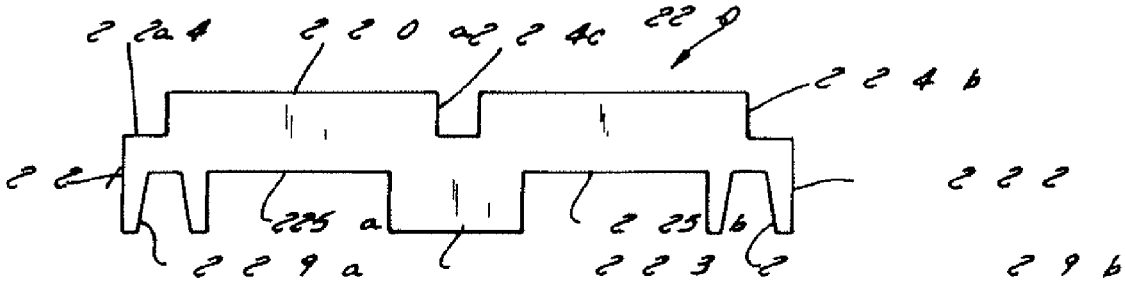
FIG. 13 is a side view of a first pallet block of the container assembly according to an alternative embodiment of the present invention shown in FIG. 12; and, FIG. 14 is a side view of a second pallet block of the container assembly according to an alternative embodiment of the present invention shown in FIG. 12.
Figure 14:
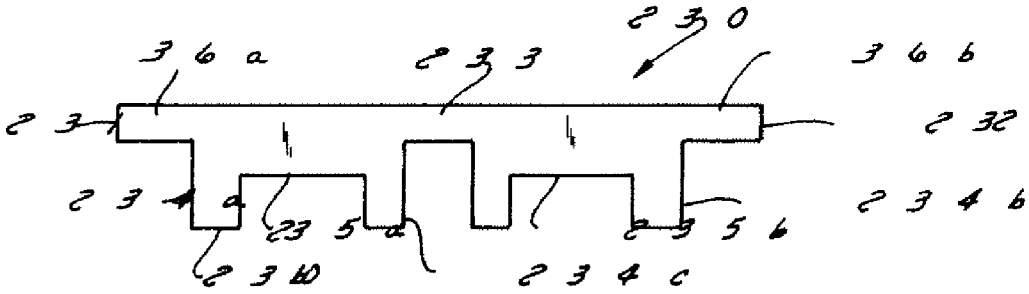
Figure 1:
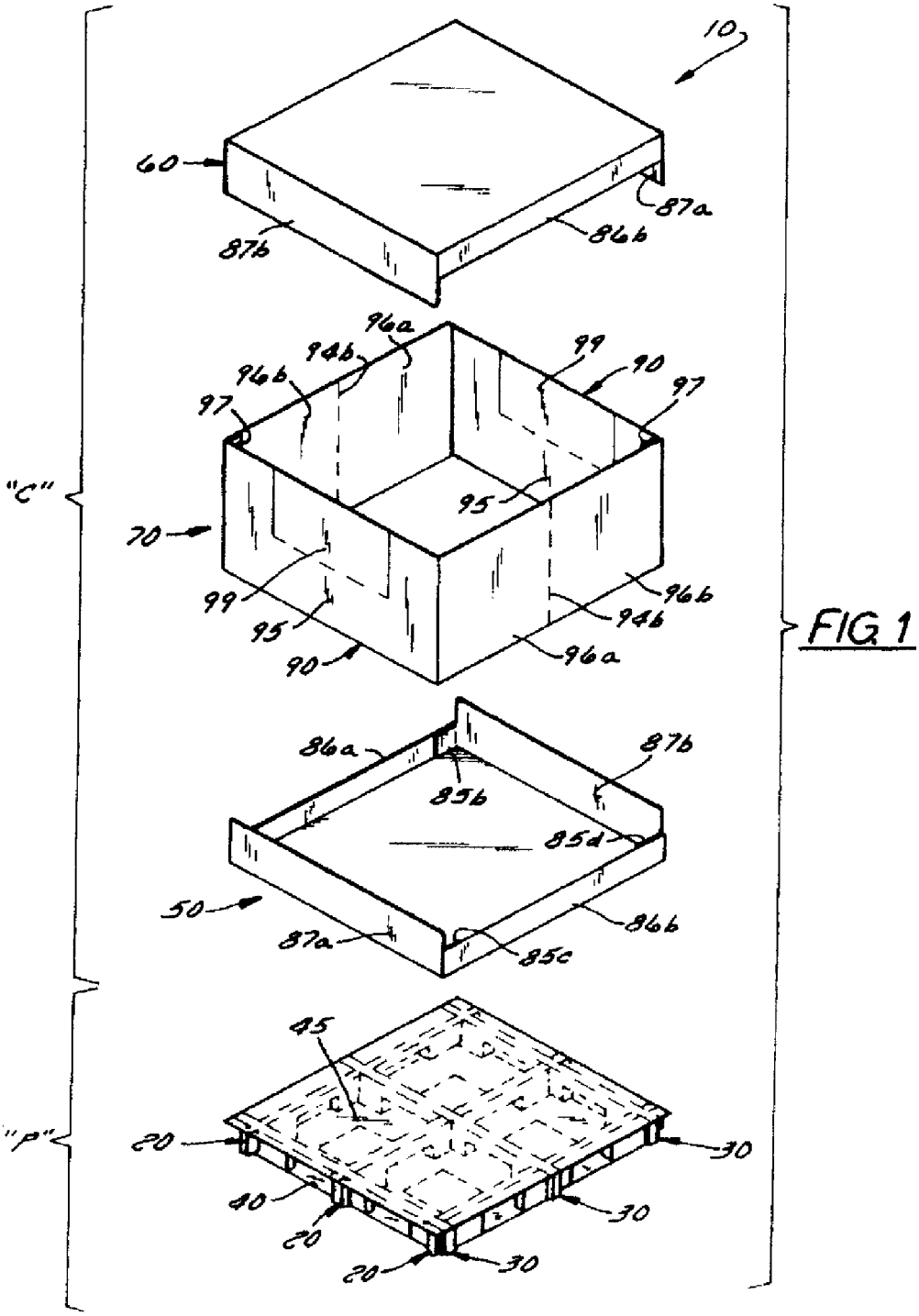
Figure 2:
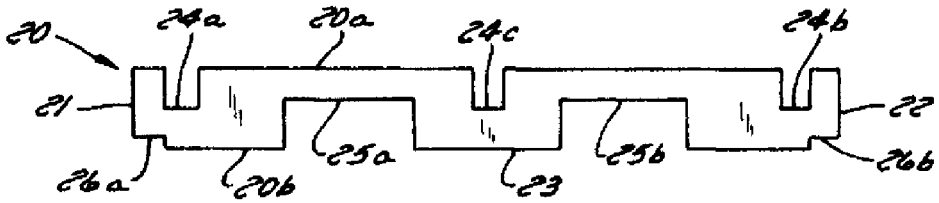
Figure 3:
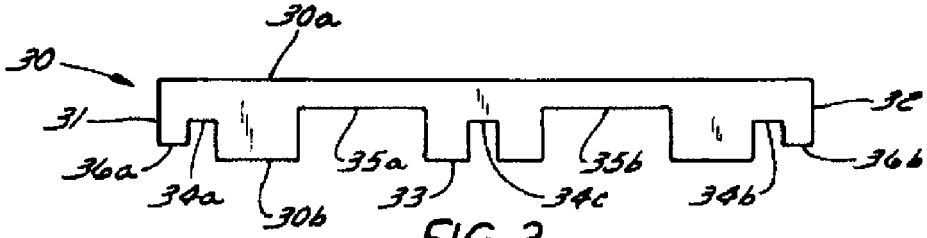
Figure 5:
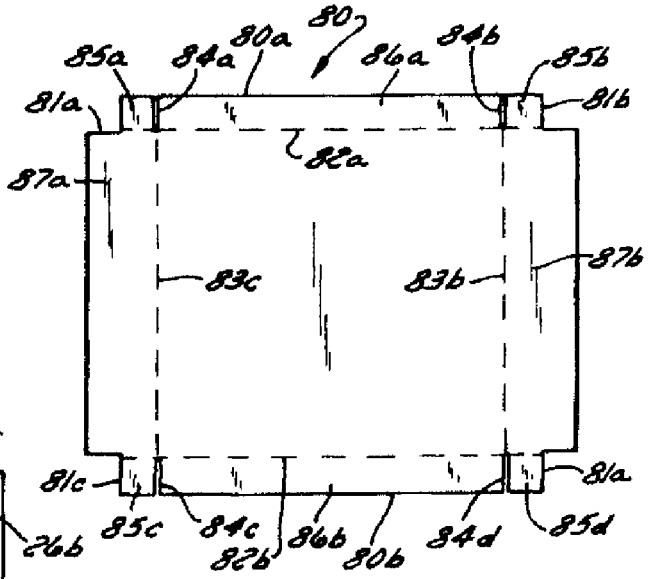
Figure 4:
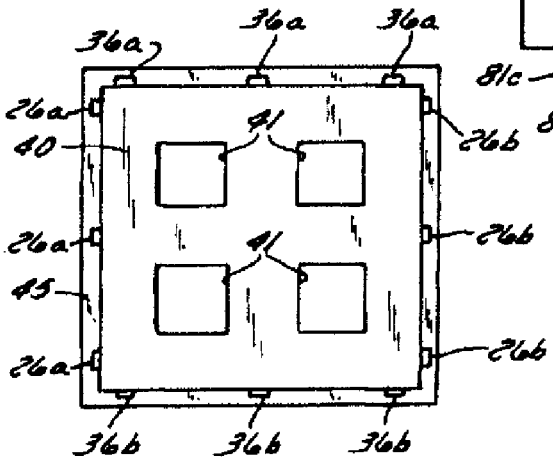
Figure 6:
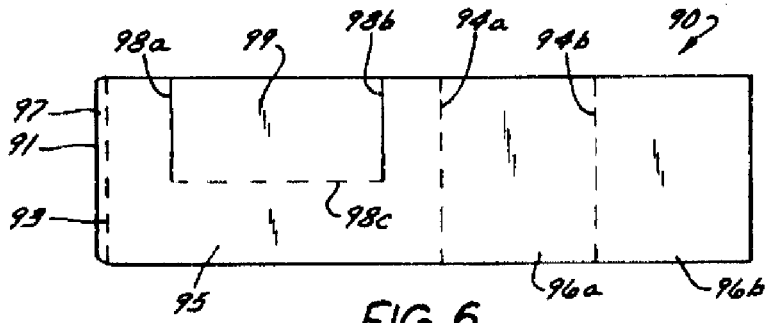
Figure 8:
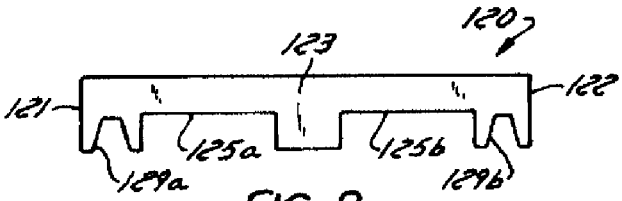
Figure 10:
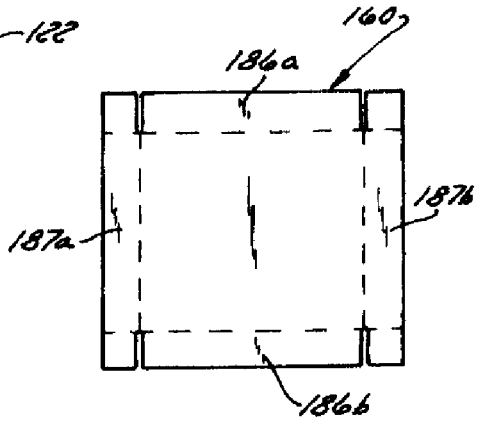
Figure 9:
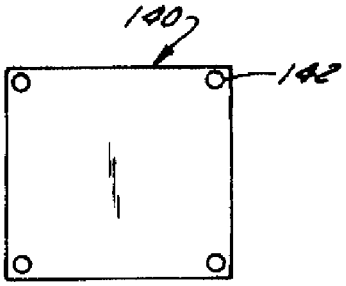
Figure 11:
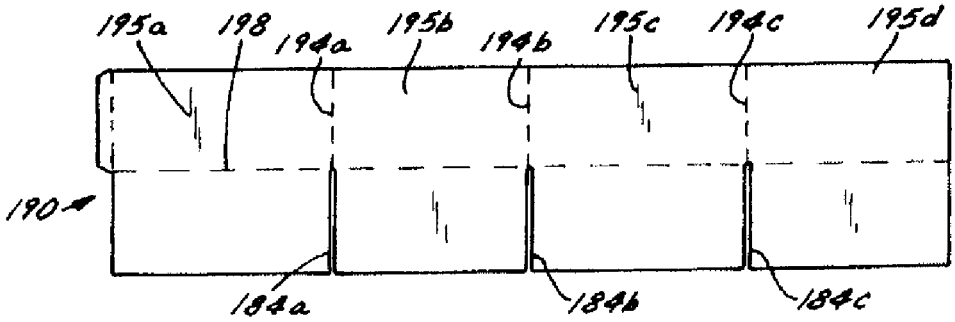
Figure 6A:
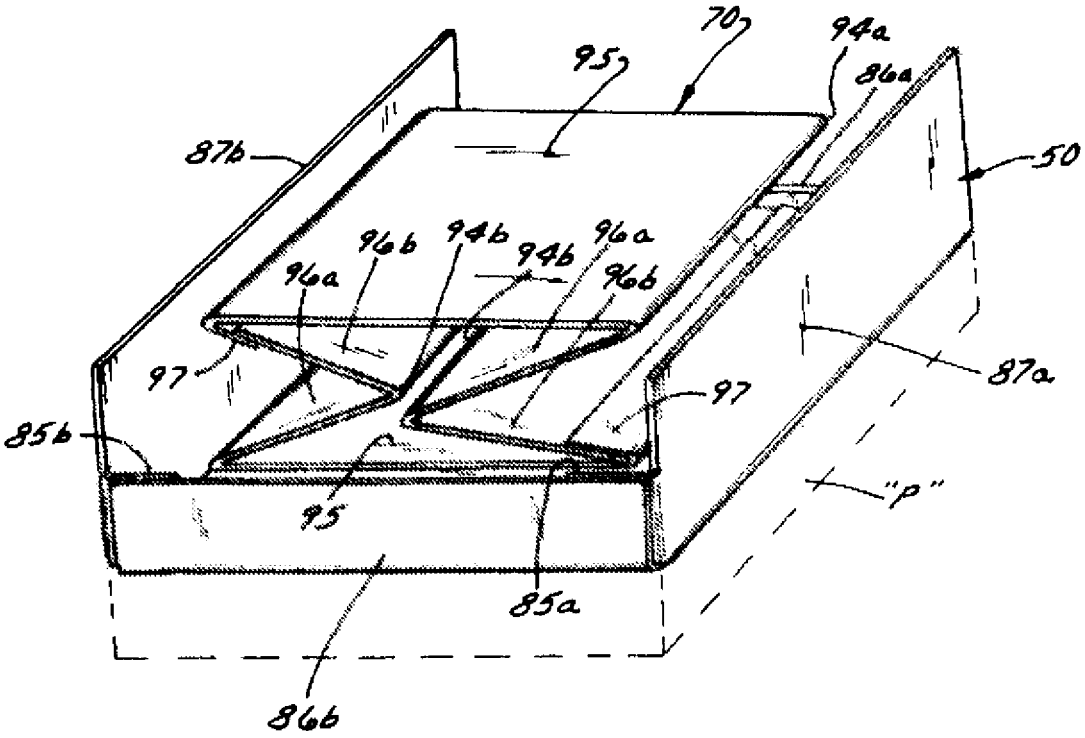
Figure 7:
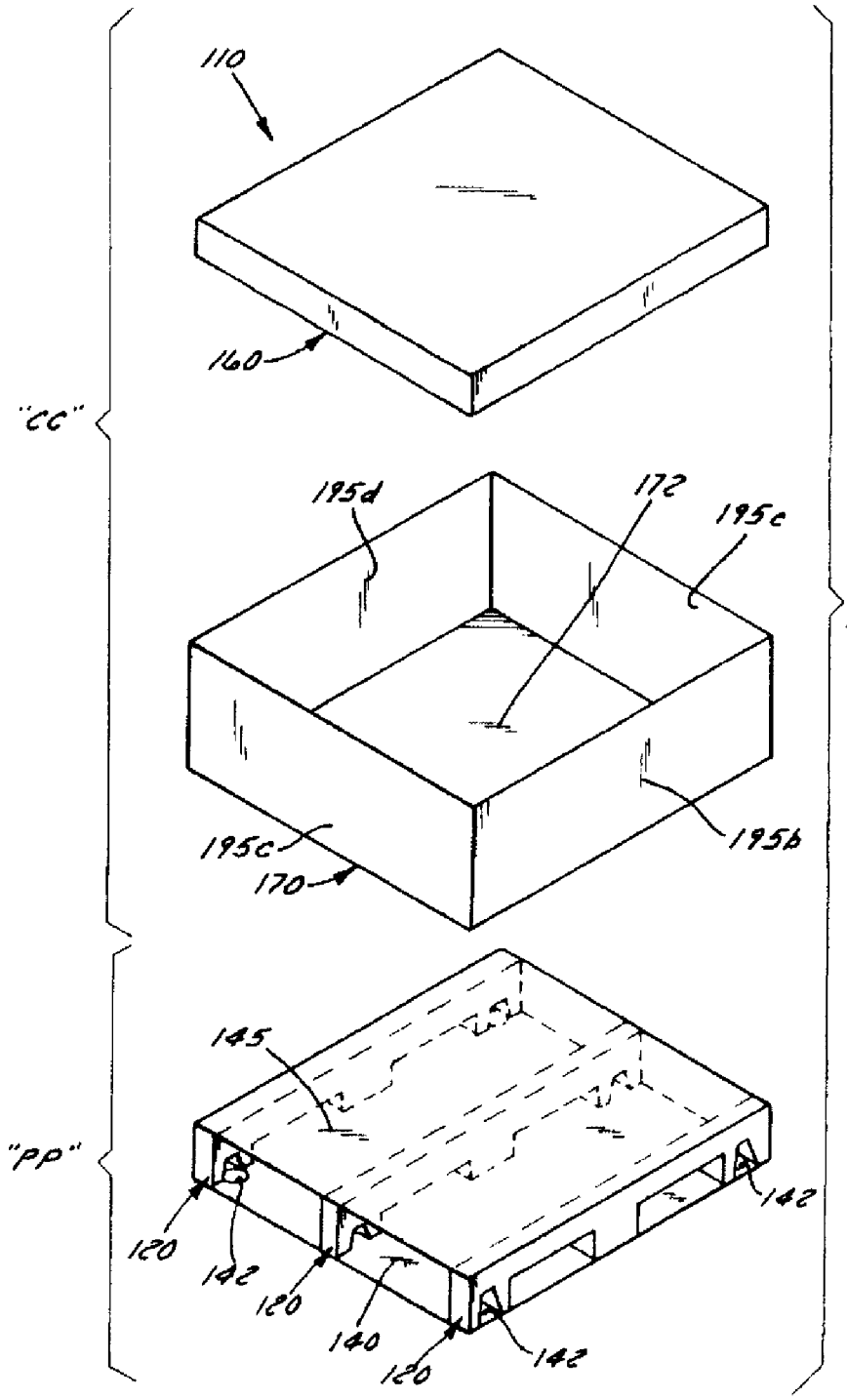
Figure 12:
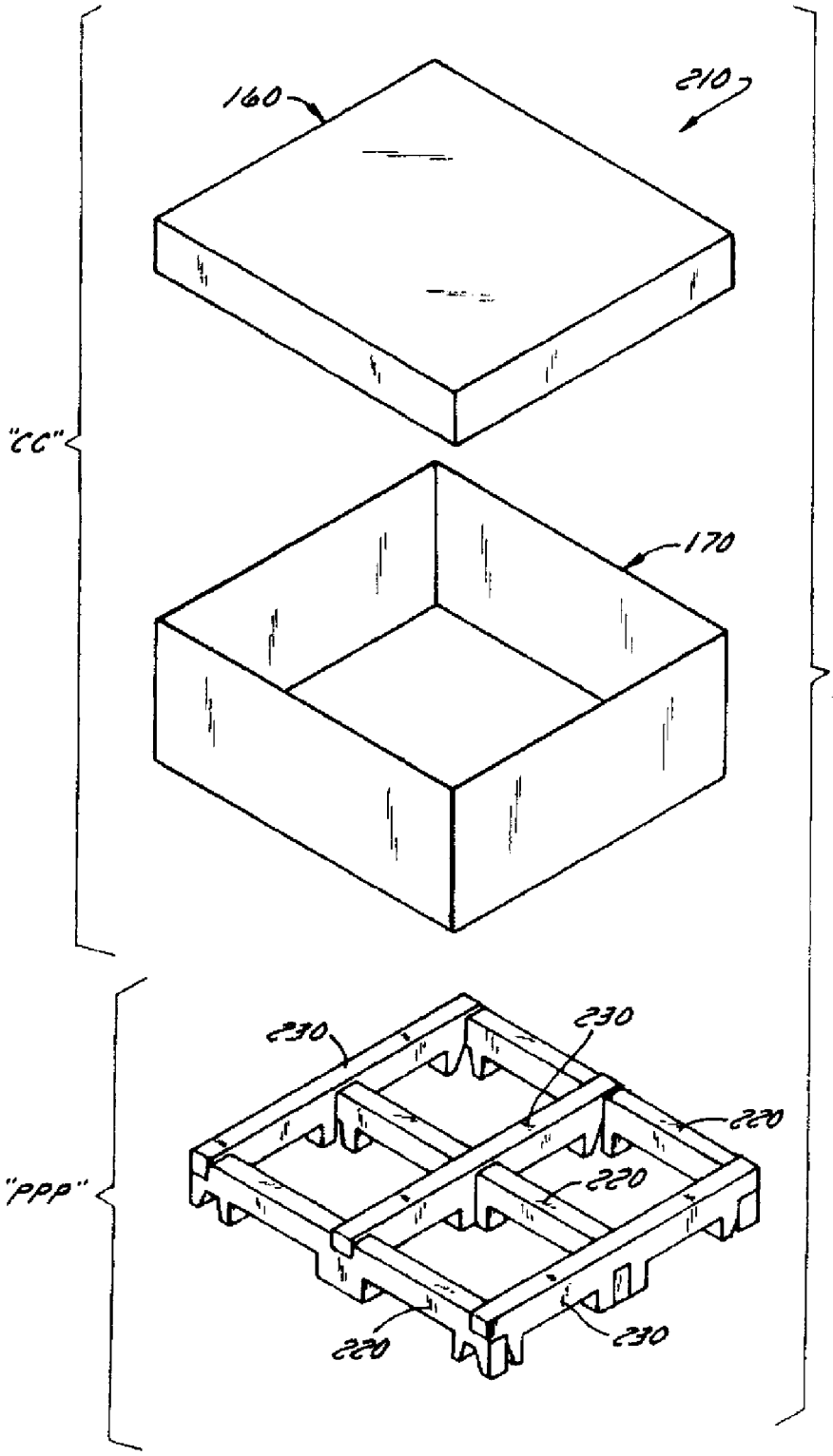
Figure 13:
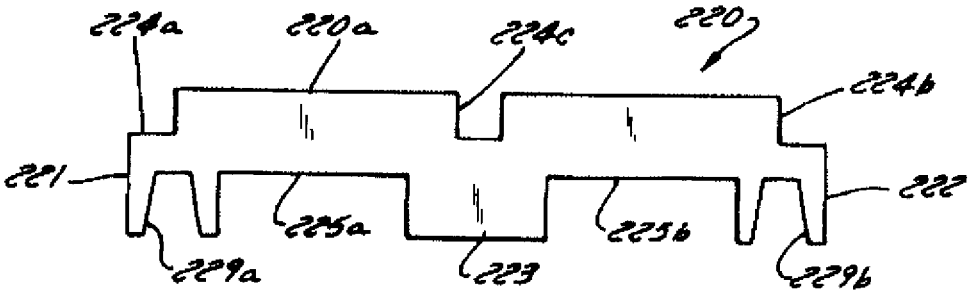
Figure 14:
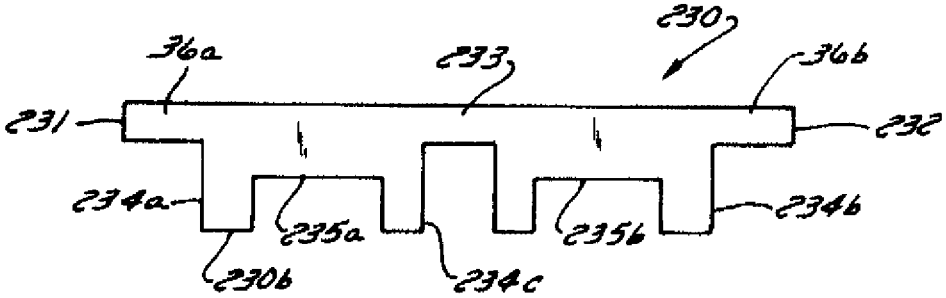

With reference to FIGS. 12-14, a shipping/storage container 210 according to yet another alternative embodiment of the present invention is shown and includes the upper tray 160 and the sidewall body 170 from the first alternative embodiment hereof shown in FIGS. 7-11 and described in greater detail above. Container unit "CC" of the first alternative embodiment hereof is used with a reinforced pallet "PPP" having locating means. The pallet "PPP" may or may not be used with a pallet deck 140 (FIGS. 7, 9) and/or a slipsheet (FIG. 7), as described above.

Referring to FIG. 13, the first pallet block 220 includes a first end 221, a second end 222, and a center section 223. The pallet block 220 may be constructed from paper or corrugated paperboard, similar to the pallet blocks 20, 30, 120 according to the preferred embodiment described above. A first recess 225*a* is provided between the first end 221 and the center section 223 and a second recess 225*b* is provided between the second end 222 and the center section 223.

A first cone-receiving recess 229*a* is provided near the first end 221 and a second cone-receiving recess 229*b* is provided near the second end 222 for locating the pallet "PPP" relative to an RPC or other container upon which the container 210 is stacked. For example, the upstanding lip of the RPC may include a conical projection. Recesses 229*a*, 229*b* are sized and shaped to receive the projection therein, thereby securely positioning the pallet "PPP" (and the container unit "CC" resting thereon) relative to the RPC. Although recesses 229*a*, 229*b* have been described herein as mating with a cone-shaped projection, persons of ordinary skill in the art will recognize that any size, shape or configuration of projection may be used without departing from either the spirit or the scope of the present invention.

One or more downward cutouts 224*a*, 224*b*, 224*c* are provided in a top surface 220*a* of the first pallet block 220 spaced along the length of the first pallet block 220, and preferably three downward cutouts 224*a*, 224*b*, 224*c* (that is, one cutout for each second pallet block 230 (FIG. 14) of the pallet "PPP" according to the present alternative embodiment hereof) are provided, wherein a first downward cutout 224*a* is provided near the first end 221 of the first pallet block 220, a second downward cutout 224*b* is provided near the second end 222 of the first pallet block 220, and a third downward cutout 224*c* is provided in the center section 223 of the first pallet block 220. It will be understood to those of ordinary skill in the art that for the purposes of describing the present alternative embodiment, the term "first pallet block" is intended to mean a "lower" pallet block, as described above with respect to the preferred embodiment hereof.

Referring particularly to FIG. 14, the second pallet block 230 preferably is a generally elongated beam element having a first end 231, a second end 232 and a center section 233. The second pallet block 230 may have any suitable cross-section for resisting bending thereof, and preferably includes a generally-rectangular cross-section. The second pallet block 230 preferably is constructed from one or more individual corrugated sheets (not shown) arranged in a side-by-side vertical orientation laminated together to form a unitary member, as described herein.

One or more upward cutouts 234*a*, 234*b*, 234*c* are provided in a bottom surface 230*b* of the second pallet block 230 spaced along the length of the second pallet block 230, and preferably three upward cutouts 234*a*, 234*b*, 34*c* (that is, one cutout for each first pallet block 220 of the pallet "PPP" according to the present alternative embodiment hereof) are provided, wherein a first upward cutout 234*a* is provided near the first end 231 of the second pallet block 230, a second upward cutout 234*b* is provided near the second end 232 of the second pallet block 230, and a third upward cutout 234*c* is provided in the center section 233 of the second pallet block 230.

One or more recesses 235*a*, 235*b* are provided in the bottom surface 230*b* of the second pallet block 230 spaced along the length of the second pallet block 230, and preferably two recesses 235*a*, 235*b* are provided, wherein a first recess 235*a* is provided spaced between the first upward cutout 234*a* and the third upward cutout 234*c*, and wherein a second recess 235*b* is provided spaced between the second upward cutout 234*b* and the third upward cutout 234*c*. It will be understood to those of ordinary skill in the art that for the purposes of describing the present alternative embodiment, the term "second pallet block" is intended to mean an "upper" pallet block, as described above with respect to the preferred embodiment hereof.

As will be described in greater detail below, first upward cutout 234*a* defines a first shoulder 236*a* in the first end 231 of the second pallet block 230 and second upward cutout 234*b* defines a second shoulder 236*b* is provided near the second end 232 of the second pallet block 230. Shoulders 236*a*, 236*b* are preferably spaced from the lower surface 30*b* towards the upper surface 230*a* thereof.

Referring now also back to FIG. 12, the pallet block matrix 220, 230 is assembled by orienting the first and second pallet blocks 220, 230, respectively, as described above, such that the downward cutouts 224*a*, 224*b*, 224*c* of the first pallet blocks 220 are received by and mate with the upward cutouts 234*a*, 234*b*, 234*c* of the second pallet blocks 230. Recesses 225*a*, 225*b*, 235*a*, 235*c* are sized and positioned on the pallet blocks 220, 230, respectively, so that openings are defined in the sides of the pallet, thereby permitting the pallet to be lifted and transported using conventional equipment, such as a fork-lift.

While the invention has been described and illustrated with reference to one or more preferred embodiments thereof, it is not the intention of the applicants that the invention be restricted to such detail. Rather, it is the intention of the applicants that the invention be defined by all equivalents, both suggested hereby and known to those of ordinary skill in the art, of the preferred embodiments falling within the scope hereof.

We claim:

1. A stackable container, comprising:

a plurality of pallet blocks arranged to define a pallet block matrix; and a container unit adapted to rest upon said pallet block matrix, wherein one or more of said pallet blocks is adapted to positively position said container relative to a support;

said container unit comprises: a container body; an upper tray adapted to cover an open upper end of said container body; and, a lower tray adapted to cover an open lower end of said container body and wherein said container body includes a removable window section; and either said upper tray or said lower tray is constructed from a foldable blank having: first, second, third and fourth corner cutouts; a first edge flap defined by a first edge fold line extending from said first corner cutout to said second corner cutout; a second edge flap defined by a second edge fold line extending from said third corner cutout to said fourth corner cutout; a first end flap defined by a first end fold line extending from said first corner cutout to said third corner cutout; and, a second end flap defined by a second end fold line extending from said second corner cutout to said fourth corner cutout.

2. The stackable container according to claim 1, wherein said container body and said lower tray are integrally formed.

3. The stackable container according to claim 1, wherein both said upper tray and said lower tray each are constructed from foldable blanks, each foldable blank having: first, second, third and fourth corner cutouts; a first edge flap defined by a first edge fold line extending from said first corner cutout to said second corner cutout; a second edge flap defined by a second edge fold line extending from said third corner cutout to said fourth corner cutout; a first end flap defined by a first end fold line extending from said first corner cutout to said third corner cutout; and, a second end flap defined by a second end fold line extending from said second corner cutout to said fourth corner cutout.

4. The stackable container according to claim 1, wherein said container body is formed from a plurality of foldable sidewall blanks connected in end-to-end fashion to define a continuous sidewall construction.

5. The stackable container according to claim 1, wherein said container body is formed from a foldable sidewall blank having a first end and a second end connected to said first end to define a continuous sidewall construction.

6. The stackable container according to claim 1, wherein said container body is collapsible.

7. The stackable container according to claim 6, wherein said upper tray is adapted to fit over said lower tray, and wherein said container body is adapted to be stored between said upper and lower frays when in a collapsed orientation.

8. The stackable container according to claim 1, wherein at least one of said plurality of pallet blocks includes a shoulder for positively positioning said container relative to said support.

9. The stackable container according to claim 1, wherein at least one of said plurality of pallet blocks includes a recess for receiving a projection provided on said support.

10. The stackable container according to claim 1, wherein said plurality of pallet blocks comprises: one or more lower pallet blocks ranged in spaced-apart relation; and, one or more upper pallet blocks arranged in spaced-apart relation, wherein at least one of said one or more upper pallet blocks is adapted to matingly engage at least one of said one or more lower pallet blocks so as to maintain said lower pallet blocks in spaced-apart relation and so as to maintain said upper pallet blocks in spaced-apart relation.

11. The stackable container according to claim 1, wherein said pallet blocks include recesses for permitting handling thereof.

12. The stackable container according to claim 1, further comprising a substantially planar pallet deck affixed to an underside of the pallet block matrix.

13. The stackable container according to claim 12, wherein said pallet deck includes one or more openings for receiving a projection provided on said support therethrough.

14. The stackable container according to claim 1, further comprising a substantially planar slipsheet affixed to an upper side of the pallet block matrix.

15. The stackable container according to claim 1, wherein said container unit is removable from said pallet block matrix.

16. The stackable container according to claim 1, wherein said support is another container having at least one projection for positively engaging said pallet block matrix.

17. The stackable container according to claim 1, wherein: said container unit includes a container body an upper tray adapted to cover an open upper end of said container body, and a lower tray adapted to cover an open lower end of said container body; and wherein said plurality of pallet blocks includes one or more lower pallet blocks arranged in spaced-apart relation, and one or more upper pallet blocks arranged in spaced-apart relation, wherein at least one of said one or more upper pallet blocks is adapted to matingly engage at least one of said one or more lower pallet blocks so as to maintain said lower pallet blocks in spaced-apart relation and so as to maintain said upper pallet blocks in spaced-apart relation; and wherein at least one of said plurality of pallet blocks includes a recess for receiving a projection provided on said support.

18. A stackable container, comprising:

a plurality of pallet blocks arranged to define a pallet block matrix; and a container unit adapted to rest upon said pallet block matrix, wherein one or more of said pallet blocks is adapted to positively position said container relative to a support;

said container unit comprises: a container body; an upper tray adapted to cover an open upper end of said container body; and, a lower tray adapted to cover an open lower end of said container body; and said container body includes a removable window section.

19. The stackable container according to claim 18, wherein said container body and said lower tray are integrally formed.

20. The stackable container according to claim 18, wherein both said upper tray and said lower tray each are constructed from foldable blanks, each foldable blank having: first, second, third and fourth corner cutouts; a first edge flap defined by a first edge fold line extending from said first corner cutout to said second corner cutout; a second edge flap defined by a second edge fold line extending from said third corner cutout to said fourth corner cutout; a first end flap defined by a first end foldline extending from said first corner cutout to said third corner cutout; and, a second end flap defined by a second end foldline extending from said second corner cutout to said fourth corner cutout.

21. The stackable container according to claim 18, wherein said container body is fanned from a plurality of foldable sidewall blanks connected in end-to-end fashion to define a continuous sidewall construction.

22. The stackable container according to claim 18, wherein said container body is formed from a foldable sidewall blank having a first end and a second end connected to said first end to define a continuous sidewall construction.

23. The stackable container according to claim 18, wherein said container body is collapsible.

24. The stackable container according to claim 23, wherein said upper tray is adapted to fit over said lower tray, and wherein said container body is adapted to be stored between said upper and lower trays when in a collapsed orientation.

25. The stackable container according to claim 18, wherein at least one of said plurality of pallet blocks includes a shoulder for positively positioning said container relative to said support.

26. The stackable container according to claim 18, wherein at least one of said plurality of pallet blocks includes a recess for receiving a projection provided on said support.

27. The stackable container according to claim 18, wherein said plurality of pallet blocks comprises: one or more lower pallet blocks arranged in spaced-apart relation; and, one or more upper pallet blocks arranged in spaced-apart relation, wherein at least one of said one or more upper pallet blocks is adapted to matingly engage at least one of said one or more lower pallet blocks so as to maintain said lower pallet blocks in spaced-apart relation and so as to maintain said upper pallet blocks in spaced-apart relation.

28. The stackable container according to claim 18, wherein said pallet blocks include recesses for permitting handling thereof.

29. The stackable container according to claim 18, further comprising a substantially planar pallet deck affixed to an underside of the pallet block matrix.

30. The stackable container according to claim 29, wherein said pallet deck includes one or more openings for receiving a projection provided on said support therethrough.

31. The stackable container according to claim 18, further comprising a substantially planar slipsheet affixed to an upperside of the pallet block matrix.

32. The stackable container according to claim 18, wherein said container unit is removable from said pallet block matrix.

33. The stackable container according to claim 18, wherein said support is another container having at least one projection for positively engaging said pallet block matrix.

34. The stackable container according to claim 18, wherein: said container unit includes a container body an upper tray adapted to cover an open upper end of said container body, and a lower tray adapted to cover an open lower end of said container body; and wherein said plurality of pallet blocks includes one or more lower pallet blocks arranged in spaced-apart relation, and one or more upper pallet blocks arranged in spaced-apart relation, wherein at least one of said one or more upper pallet blocks is adapted to matingly engage at least one of said one or more lower pallet blocks so as to maintain said lower pallet blocks in spaced-apart relation and so as to maintain said upper pallet blocks in spaced-apart relation; and wherein at least one of said plurality of pallet blocks includes a recess for receiving a projection provided on said support.

35. A stackable container, comprising:

a plurality of pallet blocks arranged to define a pallet block matrix; and a container unit adapted to rest upon said pallet block matrix, wherein one or more of said pallet blocks is adapted to positively position said container relative to a support; said container unit includes a container body an upper tray adapted to cover an open upper end of said container body, and a lower fray adapted to cover an open lower end of said container body; said plurality of pallet blocks includes one or more lower pallet blocks arranged in spaced-apart relation, and one or more upper pallet blocks arranged in spaced-apart relation, wherein at least one of said one or more upper pallet blocks is adapted to matingly engage at least one of said one or more lower pallet blocks so as to maintain said lower pallet blocks in spaced-apart relation and so as to maintain said upper pallet blocks in spaced-apart relation; and at least one of said plurality of pallet blocks includes a recess for receiving a projection provided on said support.

36. The stackable container according to claim 35, wherein said container body and said lower tray are integrally formed.

37. The stackable container according to claim 35, wherein both said upper tray and said lower tray each are constructed from foldable blanks, each foldable blank having: first, second, third and fourth corner cutouts; a first edge flap defined by a first edge foldline extending from said first corner cutout to said second cower cutout; a second edge flap defined by a second edge foldline extending from said third corner cutout to said fourth corner cutout; a first end flap defined by a first end foldline extending from said first corner cutout to said third corner cutout; and, a second end flap defined by a second end foldline extending from said second corner cutout to said fourth corner cutout.

38. The stackable container according to claim 35, wherein said container body is formed from a plurality of foldable sidewall blanks connected in end-to-end fashion to define a continuous sidewall construction.

39. The stackable container according to claim 35, wherein said container body is formed from a foldable sidewall blank having a first end and a second end connected to said first end to define a continuous sidewall construction.

40. The stackable container according to claim 35, wherein said container body is collapsible.

41. The stackable container according to claim 40, wherein said upper tray is adapted to fit over said lower tray, and wherein said container body is adapted to be stored between said upper and lower trays when in a collapsed orientation.

42. The stackable container according to claim 35, wherein at least one of said plurality of pallet blocks includes a shoulder for positively positioning said container relative to said support.

43. The stackable container according to claim 35, wherein said pallet blocks include recesses for permitting handling thereof.

44. The stackable container according to claim 35, further comprising a substantially planar pallet deck affixed to an underside of the pallet block matrix.

45. The stackable container according to claim 44, wherein said pallet deck includes one or more openings for receiving a projection provided on said support therethrough.

46. The stackable container according to claim 35, further comprising a substantially planar slipsheet affixed to an upper side of the pallet block matrix.

47. The stackable container according to claim 35, wherein said container unit is removable from said pallet block matrix.

48. The stackable container according to claim 35, wherein said support is another container having at least one projection for positively engaging said pallet block matrix.

* * * * *

UNITED STATES PATENT AND TRADEMARK OFFICE

CERTIFICATE OF CORRECTION

PATENT NO. : 7,513,365 B2
APPLICATION NO. : 11/049625
DATED : April 7, 2009
INVENTOR(S) : Adam C. Cornelius et al.

It is certified that error appears in the above-identified patent and that said Letters Patent is hereby corrected as shown below:

Delete the title page and substitute therefore the attached title page.

Delete Drawing Sheets 1 - 7 and substitute therefore the attached Drawing Sheets 1 - 7.

Column 12 Claim 7, lines 64 - 67 should be corrected as follows:

Claim 7. The stackable container according to claim 6, wherein said upper tray is adapted to fit over said lower tray, and wherein said container body is adapted to be stored between said upper and lower trays when in a collapsed orientation.

Column 14 Claim 21, lines 7 - 10 should be corrected as follows:

Claim 21. The stackable container according to claim 18, wherein said container body is formed from a plurality of foldable sidewall blanks connected in end-to-end fashion to define a continuous sidewall construction.

Column 15 Claim 35, lines 4 - 24 should be corrected as follows:

Claim 35. A stacked container, comprising:

a plurality of pallet blocks arranged to define a pallet block matrix; and a container unit adapted to rest upon said pallet block matrix, wherein one or more of said pallet blocks is adapted to positively position said container relative to a support; said container unit includes a container body and upper tray adapted to cover an open upper end of said container body, and a lower tray adapted to cover an open lower end of said container body; said plurality of pallet blocks includes one or more lower pallet blocks arranged in spaced-apart relation, and one or more upper pallet blocks arranged in spaced-apart relation, wherein

UNITED STATES PATENT AND TRADEMARK OFFICE

CERTIFICATE OF CORRECTION

PATENT NO. : 7,513,365 B2
APPLICATION NO. : 11/049625
DATED : April 7, 2009
INVENTOR(S) : Adam C. Cornelius et al.

It is certified that error appears in the above-identified patent and that said Letters Patent is hereby corrected as shown below:

Column 15 Claim 35, lines 4 - 24 should be corrected as follows: Continued at least one of said one or more upper pallet blocks is adapted to matingly engage at least one of said one or more lower pallet blocks so as to maintain said lower pallet blocks in spaced-apart relation and so as to maintain said upper pallet blocks in spaced-apart relation; and at least one of said plurality of pallet blocks includes a recess for receiving a projection provided on said support.

Signed and Sealed this

Tenth Day of November, 2009

David J. Kappos

David J. Kappos
*Director of the United States Patent and Trademark Office*

(12) United States Patent
Cornelius et al.

(10) Patent No.: US 7,513,365 B2
(45) Date of Patent: Apr. 7, 2009

(54) STACKABLE CONTAINER

(75) Inventors: Adam C. Cornelius, Hayden, AL (US); Eric J. Oberliesen, Monroe, MI (US)

(73) Assignee: International Paper Company, Memphis, TN (US)

( * ) Notice: Subject to any disclaimer, the term of this patent is extended or adjusted under 35 U.S.C. 154(b) by 375 days.

(21) Appl. No.: 11/049,625

(22) Filed: Feb. 2, 2005

(65) Prior Publication Data

US 2005/0173280 A1 Aug. 11, 2005

Related U.S. Application Data

(60) Provisional application No. 60/541,104, filed on Feb. 2, 2004.

(51) Int. Cl.
*B65D 19/00* (2006.01)

(52) U.S. Cl. ..... 206/386; 206/600; 108/56.1

(58) Field of Classification Search ..... 206/386, 206/595, 597, 598, 599, 600; 108/51.11, 108/53.1, 56.1
See application file for complete search history.

(56) References Cited

U.S. PATENT DOCUMENTS

| | | | | |
|---|---|---|---|---|
| 2,918,190 | A | 12/1959 | Martin | |
| 4,000,704 | A * | 1/1977 | Griffin, Jr. | 108/53.1 |
| 4,305,508 | A * | 12/1981 | Rodgers | 211/85.8 |
| 4,606,461 | A * | 8/1986 | Bolton, Sr. | 206/600 |
| 4,694,962 | A * | 9/1987 | Taub | 206/600 |
| 4,927,026 | A | 5/1990 | Gossler et al. | |
| 5,218,913 | A * | 6/1993 | Wineburger et al. | 108/51.3 |
| 5,318,219 | A | 6/1994 | Smith | |
| 5,441,154 | A * | 8/1995 | Yonelt, III | 206/599 |
| 5,461,988 | A * | 10/1995 | Cummings et al. | 108/51.3 |
| 5,542,541 | A | 8/1996 | Smith | |
| 6,050,410 | A * | 4/2000 | Quirion | 206/386 |
| 6,155,181 | A * | 12/2000 | Chilcutt | 108/51.3 |
| 6,332,535 | B1 * | 12/2001 | Usui et al. | 206/386 |
| 6,484,899 | B1 | 11/2002 | Garton | |
| 2002/0139702 | A1 * | 10/2002 | Greene | 206/386 |
| 2003/0052038 | A1 | 3/2003 | Boersma | |
| 2003/0102248 | A1 * | 6/2003 | Lang et al. | 206/600 |
| 2003/0102309 | A1 | 6/2003 | Hartwall | |
| 2004/0118742 | A1 * | 6/2004 | Shuert | 206/600 |

FOREIGN PATENT DOCUMENTS

| | | |
|---|---|---|
| DE | 19508101 | 1/1995 |
| WO | WO 93/17923 | 3/1992 |

* cited by examiner

*Primary Examiner*—David T Fidei
(74) *Attorney, Agent, or Firm*—Matthew M. Eslami

(57) ABSTRACT

The present invention provides a stackable container having a plurality of pallet blocks arranged to define a pallet block matrix and a container unit adapted to rest upon the pallet block matrix, wherein one or more of the pallet blocks is adapted to positively position the container relative to a support.

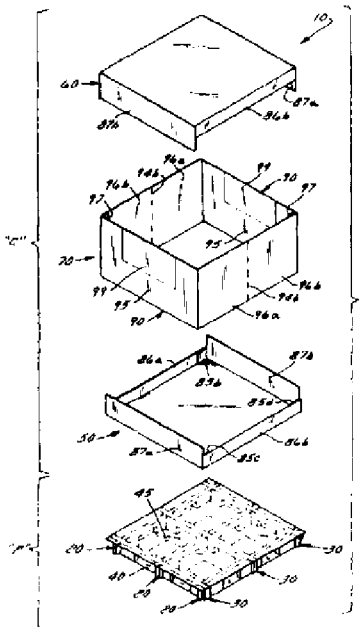

48 Claims, 7 Drawing Sheets